US007974434B2

(12) United States Patent
Funahashi

(10) Patent No.: US 7,974,434 B2
(45) Date of Patent: Jul. 5, 2011

(54) LOUDSPEAKER

(75) Inventor: Osamu Funahashi, Mie (JP)

(73) Assignee: Panasonic Corporation, Osaka (JP)

( * ) Notice: Subject to any disclaimer, the term of this patent is extended or adjusted under 35 U.S.C. 154(b) by 405 days.

(21) Appl. No.: 11/915,466

(22) PCT Filed: Feb. 5, 2007

(86) PCT No.: PCT/JP2007/051908

§ 371 (c)(1),
(2), (4) Date: Nov. 26, 2007

(87) PCT Pub. No.: WO2007/091513

PCT Pub. Date: Aug. 16, 2007

(65) Prior Publication Data

US 2009/0080686 A1 Mar. 26, 2009

(30) Foreign Application Priority Data

Feb. 6, 2006 (JP) ..... 2006-028073

(51) Int. Cl.
*H04R 25/00* (2006.01)

(52) U.S. Cl. ..... 381/398; 381/403; 381/404

(58) Field of Classification Search ..... 381/396, 381/398, 403, 404, 405, 423, 432, 433; 181/171, 181/172

See application file for complete search history.

(56) References Cited

U.S. PATENT DOCUMENTS

| | | | | |
|---|---|---|---|---|
| 3,684,052 | A * | 8/1972 | Sotome | 381/398 |
| 5,847,333 | A | 12/1998 | D'Hoogh | |
| 5,903,656 | A | 5/1999 | D'Hoogh et al. | |
| 6,655,495 | B2 | 12/2003 | Kuze et al. | |
| 7,418,107 | B2 * | 8/2008 | Milot et al. | 381/398 |

FOREIGN PATENT DOCUMENTS

| | | |
|---|---|---|
| JP | 44-024990 | 10/1969 |
| JP | 45-33465 | 10/1970 |
| JP | 50-18231 | 2/1975 |
| JP | 56-49188 Y | 11/1981 |

(Continued)

OTHER PUBLICATIONS

International Search Report for International Application No. PCT/JP2007/051908 dated May 1, 2007.

*Primary Examiner* — Huyen D Le
(74) *Attorney, Agent, or Firm* — RatnerPrestia

(57) ABSTRACT

A loudspeaker includes a frame; a magnetic circuit supported by the frame; a voice coil disposed in a magnetic gap of the magnetic circuit so as to be able to vibrate freely in the gap; a diaphragm connected to the frame at the outer rim thereof via a first edge and connected to the voice coil at the inner rim thereof; a damper connected to the voice coil at the inner rim thereof, the damper being closer to the magnetic circuit than the diaphragm is close to the magnetic circuit; and a second edge connecting the outer rim of the damper to the frame. The second edge has a protrusion protruding either toward the diaphragm or in the opposite direction. The second edge is coupled to a third edge having a protrusion protruding at least in the opposite direction in which the protrusion of the second edge protrudes. This structure enables the loudspeaker to have little distortion and high driving efficiency.

11 Claims, 5 Drawing Sheets

FOREIGN PATENT DOCUMENTS

| | | | |
|---|---|---|---|
| JP | 57-037582 | Y | 8/1982 |
| JP | 62-109598 | | 7/1987 |
| JP | 02-133097 | | 11/1990 |
| JP | 03-247099 | | 11/1991 |
| JP | 09-284890 | A | 10/1997 |
| JP | 11-510033 | | 8/1999 |
| JP | 11-266495 | A | 9/1999 |
| JP | 2003-199192 | A | 7/2003 |
| JP | 2004-007332 | | 1/2004 |
| JP | 2004-364270 | A | 12/2004 |

* cited by examiner

LOUDSPEAKER

THIS APPLICATION IS A U.S. NATIONAL PHASE APPLICATION OF PCT INTERNATIONAL APPLICATION PCT/JP2007/051908.

TECHNICAL FIELD

The present invention relates to loudspeakers.

BACKGROUND ART

As shown in FIG. 8, a conventional loudspeaker includes magnetic circuit 1A, voice coil 2A, diaphragm 3A, edge 4A, frame 5A, suspension holder 6A, and edge 7A. Voice coil 2A is disposed in a gap in magnetic circuit 1A so as to be able to vibrate freely in the gap and is connected to the inner rim of diaphragm 3A. Frame 5A is connected to the outer rim of diaphragm 3A via edge 4A. Suspension holder 6A is disposed on the rear surface of diaphragm 3A. Edge 7A connects frame 5A and suspension holder 6A. Edges 4A and 7A protrude in opposite directions to each other so as to make the vertical excursion of diaphragm 3A symmetrical to each other, thereby reducing the distortion of the loudspeaker. A well-known conventional example of the present invention is described in Patent Document 1 shown below.

The loudspeaker shown in FIG. 8 is weighty due to the weight of suspension holder 6A, which is used to securely support diaphragm 3A. The large weight does not matter very much for a bass loudspeaker which requires a large output, but causes a reduction of driving efficiency for a mid/high-range loudspeaker.

Patent Document 1: Japanese Patent Unexamined Publication No. 2004-7332

SUMMARY OF THE INVENTION

The loudspeaker of the present invention includes a frame; a magnetic circuit supported by the frame; a voice coil disposed in a magnetic gap of the magnetic circuit so as to be able to vibrate freely in the gap; a diaphragm connected to the frame at the outer rim thereof via a first edge and connected to the voice coil at the inner rim thereof; a damper connected to the voice coil at the inner rim thereof, the damper being closer to the magnetic circuit than the diaphragm is close to the magnetic circuit; and a second edge connecting the outer rim of the damper to the frame. The second edge has a protrusion protruding either toward the diaphragm or in the opposite direction. The second edge is coupled to a third edge having a protrusion protruding at least in the opposite direction in which the protrusion of the second edge protrudes. This structure enables the loudspeaker to have vertical excursion symmetrical to each other and to achieve a weight reduction, so that the loudspeaker can have reduced distortion and improved driving efficiency.

REFERENCE MARKS IN THE DRAWINGS

Figure 1:
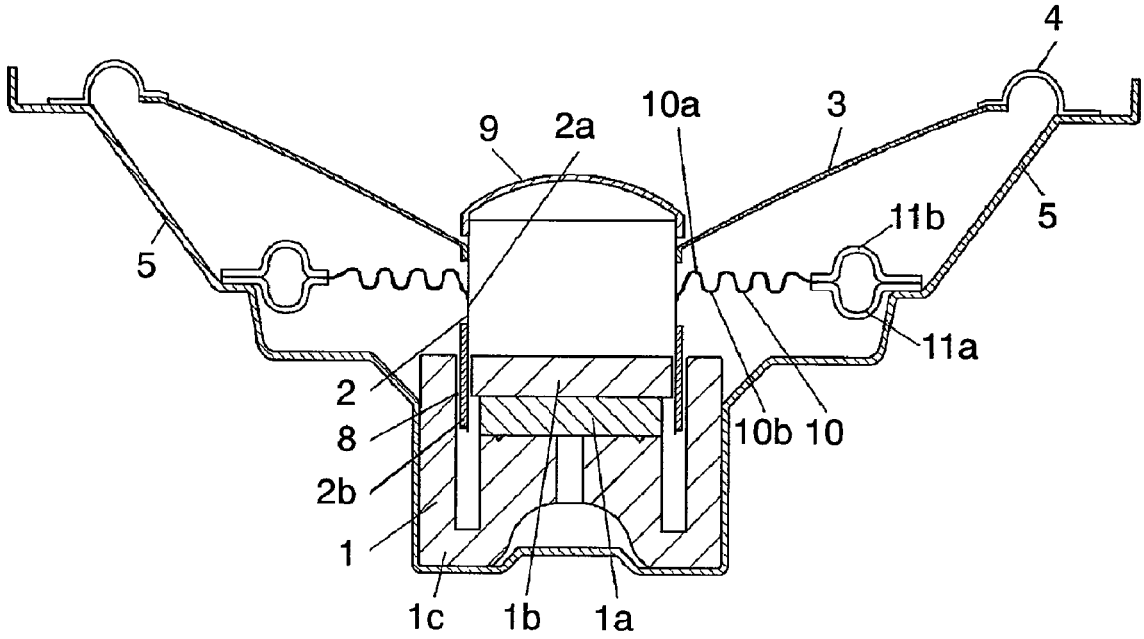
FIG. 1 is a sectional view of a loudspeaker according to an embodiment of the present invention.

1 magnetic circuit
2 voice coil
3 diaphragm
4 first edge
5 frame
8 magnetic gap
10 damper
11*a*, 11*d* second edge
11*b*, 11*c*, 11*e* third edge
11*f*, 11*m* coupled edge

DETAILED DESCRIPTION OF PREFERRED EMBODIMENT

An embodiment of the present invention is described as follows with reference to drawings.

FIG. 1 is a sectional view of a loudspeaker according to the present invention. In the loudspeaker, magnetic circuit 1 placed in the bottom center of bowl-shaped frame 5 is formed by bonding disk-shaped magnet 1*a*, disk-shaped plate 1*b*, and cylindrical yoke 1*c* together. Between the inner-side surface of the side wall of yoke 1*c* and the outer-side surface of plate 1*b* is formed cylindrical magnetic gap 8 open toward the top surface of magnetic circuit 1.

Voice coil 2 consists of cylindrical main body 2*a* and coil 2*b* coiled around main body 2*a*. Voice coil 2, which is disposed to be able to move vertically in magnetic gap 8, vibrates thin dish-shaped diaphragm 3 to reproduce sound. The top of voice coil 2 is covered with dust cap 9 to prevent dust.

Diaphragm 3 is the sound source of the loudspeaker and mainly made of the mixture of pulp and resin having both high hardness and an appropriate internal loss. Diaphragm 3 is connected at its outer rim to the open end of frame 5 via upwardly protruding first edge 4 (hereinafter, edge 4) and is fixed at its inner rim to the outer surface of main body 2*a* of voice coil 2. Edge 4 is made of materials such as foamed resin, SBR rubber, or cloth so as not to apply a dynamic load to diaphragm 3. Examples of the foamed resin include foamed urethane resin and foamed rubber.

Figure 2:
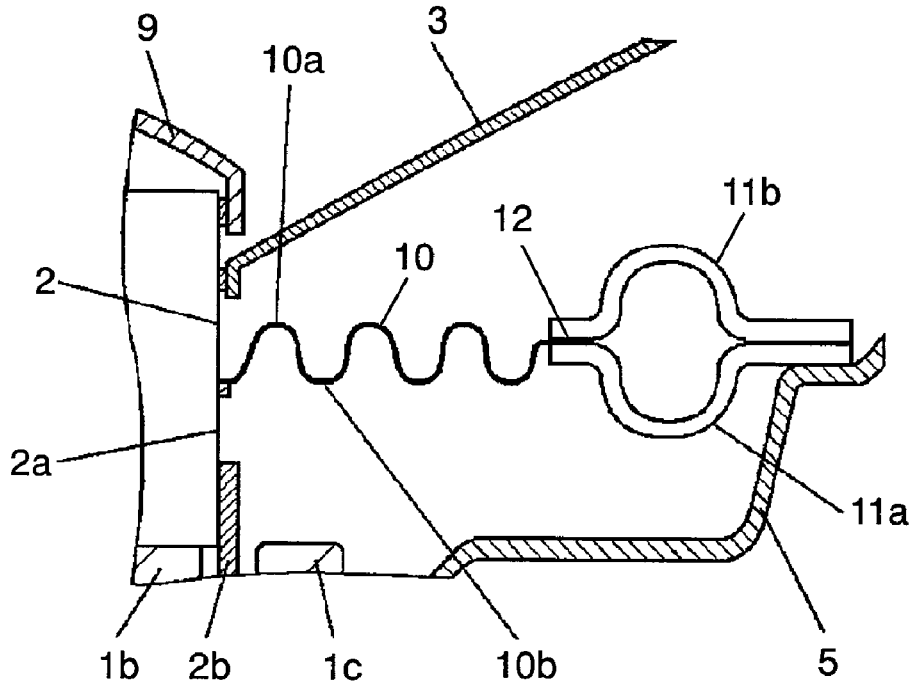
FIG. 2 is an enlarged sectional view of an essential part of the loudspeaker according to the embodiment of the present invention.

As shown in FIGS. 1 and 2, the inner rim of damper 10 is connected to a portion of the outer surface of main body 2*a* of voice coil 2, the portion being closer to magnetic circuit 1 than the portion where diaphragm 3 is fixed is close to magnetic circuit 1. In other words, in FIG. 1, damper 10 is connected to a portion below the portion where diaphragm 3 is fixed. The outer rim of damper 10, on the other hand, is connected to frame 5 via second edge 11*a* (hereinafter, edge 11*a*), which is independent of damper 10.

Damper 10 has a corrugated ring-like so that it can be flexible as voice coil 2 moves. Similar to edge 4 attached to diaphragm 3, damper 10 is made of materials such as foamed urethane resin, foamed rubber, SBR rubber, or cloth so as not to apply a large dynamic load to diaphragm 3. Edge 11*a* may protrude either toward the frame (downward) or toward diaphragm 3 (upward) as long as the protrusion is in the opposite direction to the protrusion of edge 4. Since edge 4 has an upward semicircular cross section as shown in FIG. 1 in the present embodiment, edge 1*a* protrudes downward or toward frame 5 and has a semicircular cross section.

In the loudspeaker of the present embodiment, edge 11*a* is coupled to third edge 11*b* (hereinafter, edge 11*b*) having a protrusion protruding at least in the opposite direction to the protrusion of edge 11*a*. Edge 11*b* is also made of materials such as foamed resin, SBR rubber, or cloth so as not to apply a dynamic load to diaphragm 3. Examples of the foamed resin include foamed urethane resin and foamed rubber. Since edge 11*a* has a downward semicircular cross section as shown in FIG. 1 in the present embodiment, edge 11*b* has an opposite or upward semicircular cross section.

The Young's moduli of first edge 4, second edge 11*a*, and third edge 11*b* preferably have the following relationship: first edge 4 has the lowest, second edge 11*a* has the highest, and third edge 11*b* has a middle Young's modulus. The reason for setting the Young's moduli in this manner will be described in detail later. The lower the Young's modulus, the softer the edges become. The higher the Young's modulus, the harder the edges become.

In the loudspeaker of the present embodiment, when coil 2*b* of voice coil 2 is applied with a voice signal, the voice signal reacts with the magnetic field of magnetic gap 8 and moves voice coil 2 vertically, thereby vibrating diaphragm 3 to generate sound. The provision of edge 11*b* in addition to edge 11*a* at the outer rim of damper 10 enables the loudspeaker to have reduced distortion and improved driving efficiency.

Damper 10 is originally provided to reduce rolling during the movement of voice coil 2 by being connected to voice coil 2 at its inner rim and to frame 5 at its outer rim. To achieve this purpose, damper 10 has a corrugated ring-like so as to have elasticity to follow the movement of voice coil 2.

Such a corrugated ring-like, however, causes a larger load on the movement of voice coil 2 as voice coil 2 has a larger amount of excursion, although it hardly causes a large load when the amount of excursion is small.

To overcome this problem, in the present embodiment, the outer rim of damper 10 is connected to frame 5 via edges 11*a* and 11*b* on which stress is applied when voice coil 2 has a large excursion and damper 10 becomes a load. The stress elastically deforms edges 11*a* and 11*b* having an early circular cross section so as to prevent damper 10 from disturbing the excursion of voice coil 2 when the amount of excursion becomes large. This enables the loudspeaker to have reduced distortion and improved driving efficiency.

In the present embodiment, voice coil 2 is supported in the upward and downward directions by two supports. More specifically, the first support consists of diaphragm 3 and edge 4, and the second support is a combination consisting of damper 10 and edges 11*a*, 11*b*. In order to improve the driving efficiency of diaphragm 3, edge 4 has a reduced thickness for weight reduction, thereby reducing the total weight of edge 4 and diaphragm 3.

However, reducing the thickness of edge 4 is lowered the strength of supporting voice coil 2. In order to compensate for the diminishment, edges 11*a* and 11*b* are made larger in thickness than edge 4. As a result, the combination consisting of damper 10 and edges 11*a*, 11*b* has a higher Young's modulus, or is harder, than edge 4.

In the aforementioned structure, voice coil 2 is predominantly supported by the second support, which is the combination consisting of damper 10 and edges 11*a*, 11*b*. Therefore, in order to reduce the distortion of vertical movement of diaphragm 3, the combination consisting of damper 10 and edges 11*a*, 11*b* is required to be applied with a load from above and a load from below which are as close to each other as possible.

The following is a description of the shape of edge 11*a* of the embodiment shown in FIG. 2.

Since it protrudes toward the frame with respect to diaphragm 3 (downward) in the embodiment shown in FIG. 2, edge 11*a* is likely to deform downward and unlikely to deform upward, that is, toward diaphragm 3.

Therefore, there is provided third edge 11*b* (hereinafter, edge 11*b*) to compensate for the difference of edge 11*a* in susceptibility to deformation between the upward and downward directions.

Damper 10 has a corrugated ring-like consisting of a plurality of first protruding portions 10*a* protruding toward diaphragm 3 and a plurality of second protruding portions 10*b* protruding in the opposite direction to first protruding portions 10*a*. This enables damper 10 to be applied with nearly the same load from above and from below.

In contrast, edge 11*a* is likely to deform downward because it protrudes downward only. Therefore, in the present embodiment, the load difference of edge 11*a* between above and below is compensated by providing edge 11*b*, which is coupled to edge 11*a*.

Edge 11*b* of the present embodiment shown in FIG. 2, which protrudes upward or toward diaphragm 3, is itself likely to deform upward and unlikely to deform downward. Therefore, edges 11*a* and 11*b* can be coupled together in such a manner as to have a nearly circular cross section, thereby nearly equalizing the sizes of the load applied from above and the load applied from below on edges 11*a* and 11*b* thus coupled.

Edges 11*a* and 11*b* are described in detail as follows. In the present embodiment, third edge 11*b* has a slightly lower Young's modulus than second edge 11*a*. This is because of the consideration of the load of upwardly protruding edge 4 connecting the outer rim of diaphragm 3 to frame 5 as shown in FIG. 1. In order to make third edge 11*b* have a lower Young's modulus than second edge 11*a*, third edge 11*b* is made of a foamed resin, and second edge 11*a* is made of a rubber material. The foamed resin can be, for example, a foamed urethane resin, and the rubber material can be, for example, SBR rubber.

As described above, edge 4 has a reduced thickness for weight reduction so as to reduce the total weight of edge 4 and diaphragm 3, thereby improving the driving efficiency of diaphragm 3. Therefore, edge 4 is never applied with a large load by the vertical movement of diaphragm 3. Even so, since edge 4 protruding upward as shown in FIG. 1 is likely to deform upward and unlikely to deform downward, edge 4 has a slight load difference between above and below.

That is the reason edge 11*b* has a slightly lower Young's modulus, or is softer, than edge 11*a* in the present embodiment.

More specifically, edges 4 and 11*b* both protrude upward and therefore are more susceptible to upward movement than downward movement. Edge 11*a*, on the other hand, protrudes downward and therefore is more susceptible to downward movement than upward movement. Therefore, it is necessary to consider edges 11*b* and 4 as one set to balance with one edge 11*a*, and that is the reason edge 11*b* has a slightly lower Young's modulus than edge 11*a* as described above. This enables diaphragm 3 to have vertical excursion symmetrical to each other so as to reduce the distortion of the loudspeaker. Furthermore, edge 4 has a reduced weight to provide the loudspeaker with high driving efficiency even when used as a mid/high-range loudspeaker.

In such a structure where damper 10 is connected to frame 5 via edges 11*a* and 11*b*, the corrugated ring-like of damper 10 can ensure the excursion linearity, that is, power linearity for loudspeaker input power until voice coil 2 has a excursion of a certain size. When the excursion of voice coil 2 becomes larger than a predetermined level, so that the power linearity becomes hard to ensure, the linearity can be compensated by the elasticity of edges 11*a* and 11*b*. In order to achieve these features, the edge formed by coupling edges 11*a* and 11*b* together preferably has a higher Young's modulus than damper 10. The edge formed by coupling the second and third edges together is hereinafter referred to as the coupled edge.

It is preferable that the coupled edge has a different Young's modulus from damper 10 and functions independently of damper 10 according to the excursion of voice coil 2. The independence of the coupled edge of damper 10 can be ensured by making the Young's modulus between damper 10 and edges 11*a*, 11*b*, more specifically, in termination area 12 between damper 10 and edges 11*a*, 11*b* larger than the Young's moduli of damper 10 and edges 11*a*, 11*b*.

Termination area 12 can have a higher Young's modulus than damper 10 and edges 11*a*, 11*b* preferably, for example, by bonding edges 11*a*, 11*b* and damper 10 together using an acrylic or other hard binder or by applying a reinforcing member to termination area 12.

Figure 3:
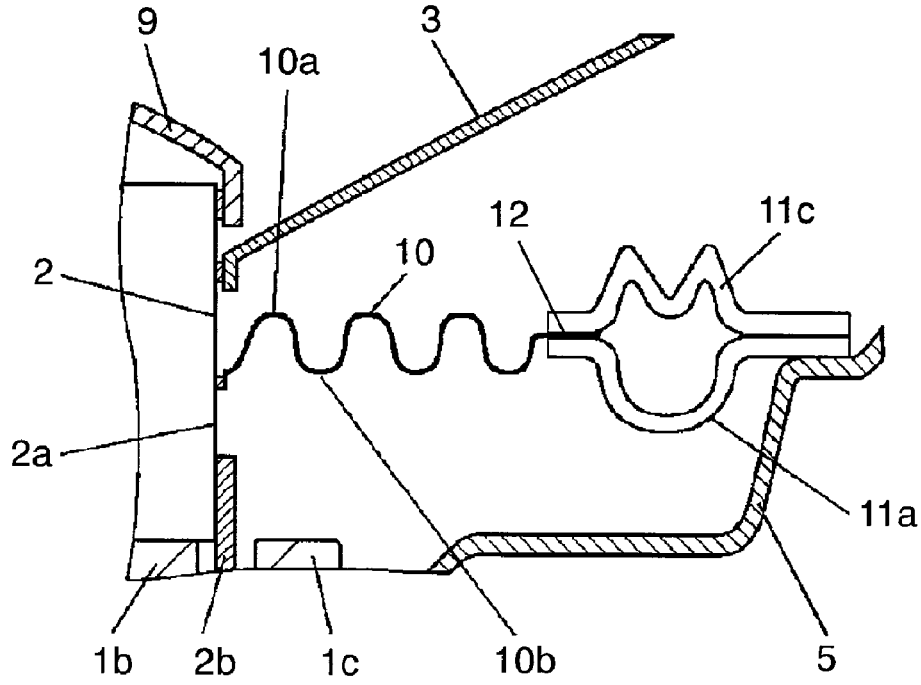
FIG. 3 is a sectional view of a loudspeaker according to another embodiment of the present invention.
Figure 4:
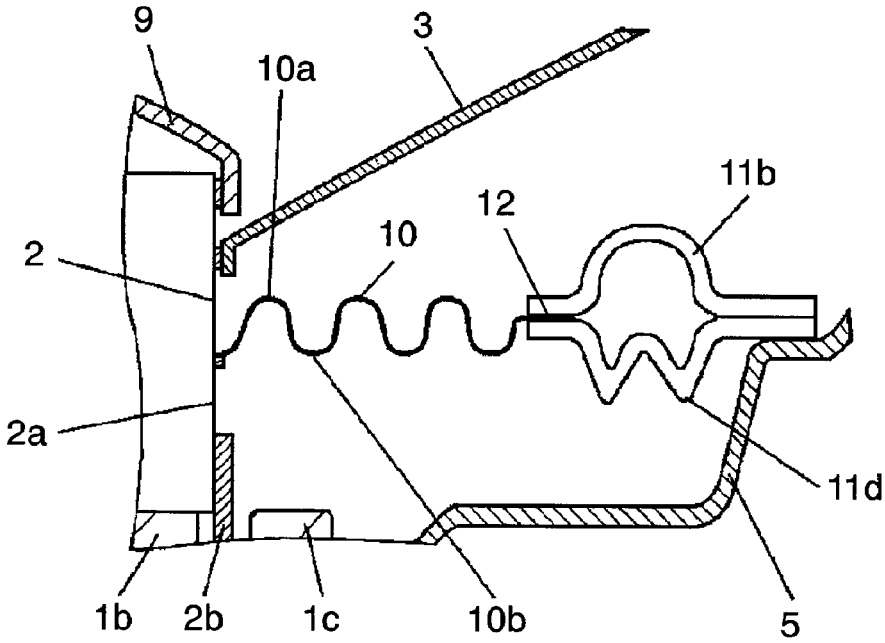
FIG. 4 is a sectional view of a loudspeaker according to further another embodiment of the present invention.
Figure 5:
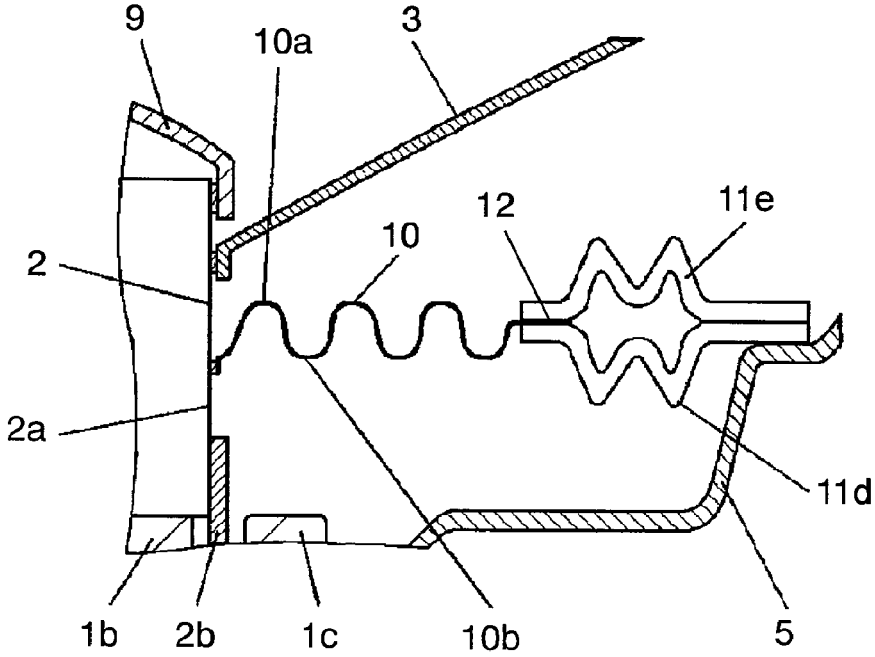
FIG. 5 is a sectional view of a loudspeaker according to further another embodiment of the present invention.

FIGS. 3 to 5 show other embodiments where only damper 10 and edges 11*a*, 11*b* are different from those shown in FIGS. 1 and 2. The other portions are identical and referred to with the same numerals as those shown in FIGS. 1 and 2 and their description will be simplified.

The embodiment shown in FIG. 3 includes third edge 11*c* (hereinafter, edge 11*c*) in place of edge 11*b* shown in FIGS. 1 and 2. Edge 11*c* has a corrugated shape consisting of two protrusions protruding toward diaphragm 3 and one protrusion protruding in the opposite direction when seen in a cross section.

Edge 11*c* is also made of materials such as foamed urethane resin, foamed rubber, SBR rubber, or cloth so as not to apply a large dynamic load to diaphragm 3.

Having two upward protrusions and one downward protrusion, edge 11*c* is likely to deform upward and unlikely to deform downward in FIG. 3. Therefore, coupling edge 11*c* to edge 11*a* as shown in FIG. 3 can nearly equalize the sizes of the load applied from above and the load applied from below on edges 11*a* and 11*c* thus coupled.

The following is a more detailed description of edges 11*a* and 11*c*. Edge 11*c* has a slightly lower Young's modulus than edge 11*a*. This is because of the consideration of the load of edge 4, which also upwardly protrudes in the present embodiment in the same manner as in FIG. 1 so as to connect the outer rim of diaphragm 3 to frame 5.

In FIG. 1, edge 4 has a reduced thickness for weight reduction so as to reduce the total weight of edge 4 and diaphragm 3, thereby improving the driving efficiency of diaphragm 3. Therefore, edge 4 is never applied with a large load by the vertical movement of diaphragm 3. Even so, since edge 4 protruding upward is likely to deform upward and unlikely to deform downward, edge 4 has a slight load difference between above and below.

That is the reason edge 11*c* has a slightly lower Young's modulus than edge 11*a* in the present embodiment.

More specifically, in FIG. 3, edge 4 having one upward protrusion and edge 11*c* having two upward protrusions when seen in a cross section are more likely to move upward than downward. On the other hand, edge 11*a* having one downward protrusion when seen in a cross section is more likely to move downward than upward. Therefore, it is necessary to optimize edge 11*c* and edge 4 as one set to balance with one edge 11*a*. Thus, edge 11*c* has a slightly lower Young's modulus than edge 11*a*.

This enables diaphragm 3 to have vertical excursion symmetrical to each other so as to reduce the distortion of the loudspeaker. Furthermore, edge 4 has a reduced weight so as to provide the loudspeaker with high driving efficiency even when used as a mid/high-range loudspeaker.

The embodiment shown in FIG. 4 includes second edge 11*d* (hereinafter, edge 11*d*) in place of second edge 1*a* shown in FIGS. 1 and 2. Edge 11*d* has a corrugated shape consisting of one protrusion protruding upward or toward diaphragm 3 and two protrusions protruding downward when seen in a cross section.

Edge 11*d* is also made of materials such as foamed urethane resin, foamed rubber, SBR rubber, or cloth so as not to apply a large dynamic load to diaphragm 3.

Having one upward protrusion and two downward protrusions, edge 11*d* is likely to deform downward and unlikely to deform upward in the present embodiment shown in FIG. 4. Therefore, coupling edges 11*d* and 11*b* together as shown in FIG. 4 can nearly equalize the sizes of the load applied from above and the load applied from below on edges 11*d* and 11*b* thus coupled.

The following is a more detailed description of edges 11*d* and 11*b*. Edge 11*b* has a slightly lower Young's modulus than edge 11*d*. This is because of the consideration of the load of edge 4, which also upwardly protrudes in the present embodiment in the same manner as in FIG. 1 so as to connect the outer rim of diaphragm 3 to frame 5.

In FIG. 1, edge 4 has a reduced thickness for weight reduction so as to reduce the total weight of edge 4 and diaphragm 3, thereby improving the driving efficiency of diaphragm 3. Therefore, edge 4 is never applied with a large load by the vertical movement of diaphragm 3. Even so, the difference in shape of edge 4 between the upper and lower sides is likely to cause edge 4 to have a slight load difference between above and below.

That is the reason edge 11*b* has a slightly lower Young's modulus, or is softer, than edge 11*d* in the present embodiment.

More specifically, in FIG. 4, edges 4 and 11*b* both protrude upward when seen in a cross section and therefore are more susceptible to upward movement than downward movement. Edge 11*d*, on the other hand, has two downward protrusions when seen in a cross section and therefore is more susceptible to downward movement than upward movement. Therefore, it is necessary to optimize edges 11*b* and 4 as one set to balance with one edge 11*d*. Thus, edge 11*b* has a slightly lower Young's modulus than edge 11*d*.

This enables diaphragm 3 to have vertical excursion symmetrical to each other, so as to reduce the distortion of the loudspeaker. Furthermore, edge 4 has a reduced weight to provide the loudspeaker with high driving efficiency even when used as a mid/high-range loudspeaker.

The embodiment shown in FIG. 5 includes edge 11*d* of FIG. 4 and third edge 11*e* (hereinafter, edge 11*e*) respectively in place of edges 11*a* and 11*b* shown in FIGS. 1 and 2. Edge 11*d* has a corrugated shape consisting of one upward protrusion and two downward protrusions when seen in a cross section. Edge 11*e*, on the other hand, has a corrugated shape consisting of two upward protrusions and one downward protrusion when seen in a cross section.

Edges 11*d* and 11*e* are also made of materials such as foamed urethane resin, foamed rubber, SBR rubber, or cloth so as not to apply a large dynamic load to diaphragm 3.

Having one upward protrusion and two downward protrusions, edge 11*d* is likely to deform downward and unlikely to deform upward in the present embodiment shown in FIG. 5. Having two upward protrusions and one downward protrusion, edge 11*e* is likely to deform upward and unlikely to deform downward in FIG. 5.

Therefore, coupling edges 11*d* and 11*e* together as shown in FIG. 5 can nearly equalize the sizes of the load applied from above and the load applied from below on edges 11*d* and 11*e* thus coupled.

The following is a more detailed description of edges 11*d* and 11*e*. Edge 11*e* has a slightly lower Young's modulus than edge 11*d*. This is because of the consideration of the load of edge 4, which also upwardly protrudes in the present embodiment in the same manner as in FIG. 1 so as to connect the outer rim of diaphragm 3 to frame 5.

Edge 4 has a reduced thickness for weight reduction so as to reduce the total weight of edge 4 and diaphragm 3, thereby improving the driving efficiency of diaphragm 3. Therefore, edge 4 is never applied with a large load by the vertical movement of diaphragm 3. Even so, the difference in shape of edge 4 between the upper and lower sides is likely to cause edge 4 to have a slight load difference between above and below.

That is the reason edge 11*e* has a slightly lower Young's modulus, or is softer, than edge 11*d* in the present embodiment.

More specifically, in FIG. 5, voice coil 2 is more susceptible to upward movement than downward movement due to the shapes of edges 4 and 11*e*, and is more susceptible to downward movement than upward movement due to the shape of edge 11*d*. Therefore, it is necessary to optimize edges 11*e* and 4 as one set to balance with one edge 11*d*. Thus, edge 11*e* has a slightly lower Young's modulus than edge 11*d*.

Figure 6:
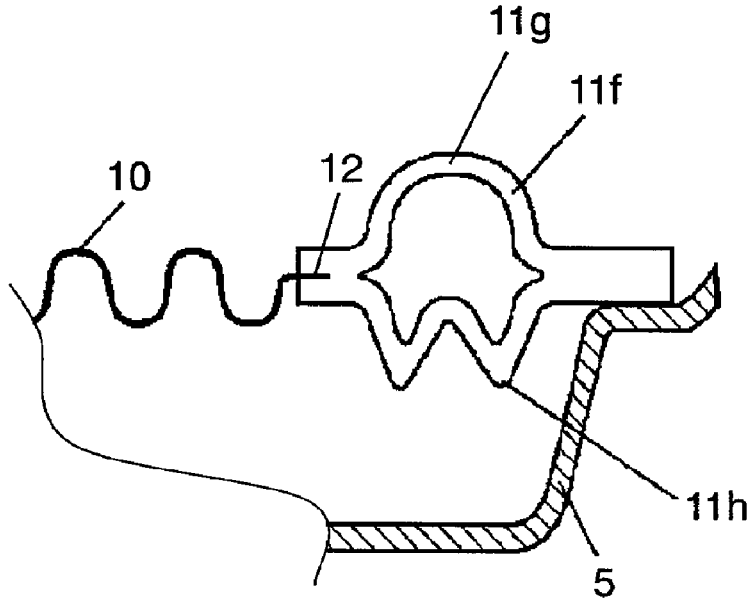
FIG. 6 is a partial sectional view of a coupled edge and its vicinity in a loudspeaker according to further another embodiment of the present invention.
Figure 7:
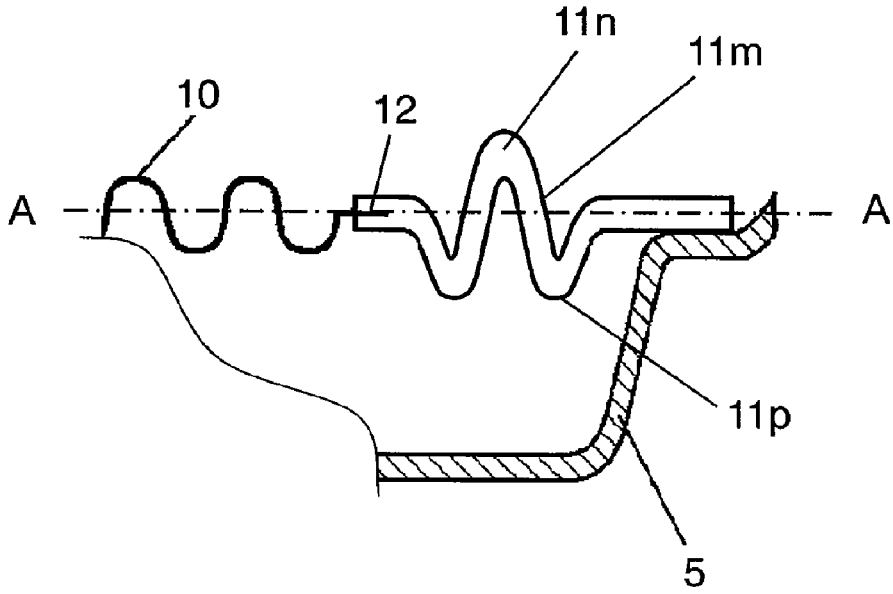
FIG. 7 is a partial sectional view of a coupled edge and its vicinity in a loudspeaker according to further another embodiment of the present invention.
Figure 8:
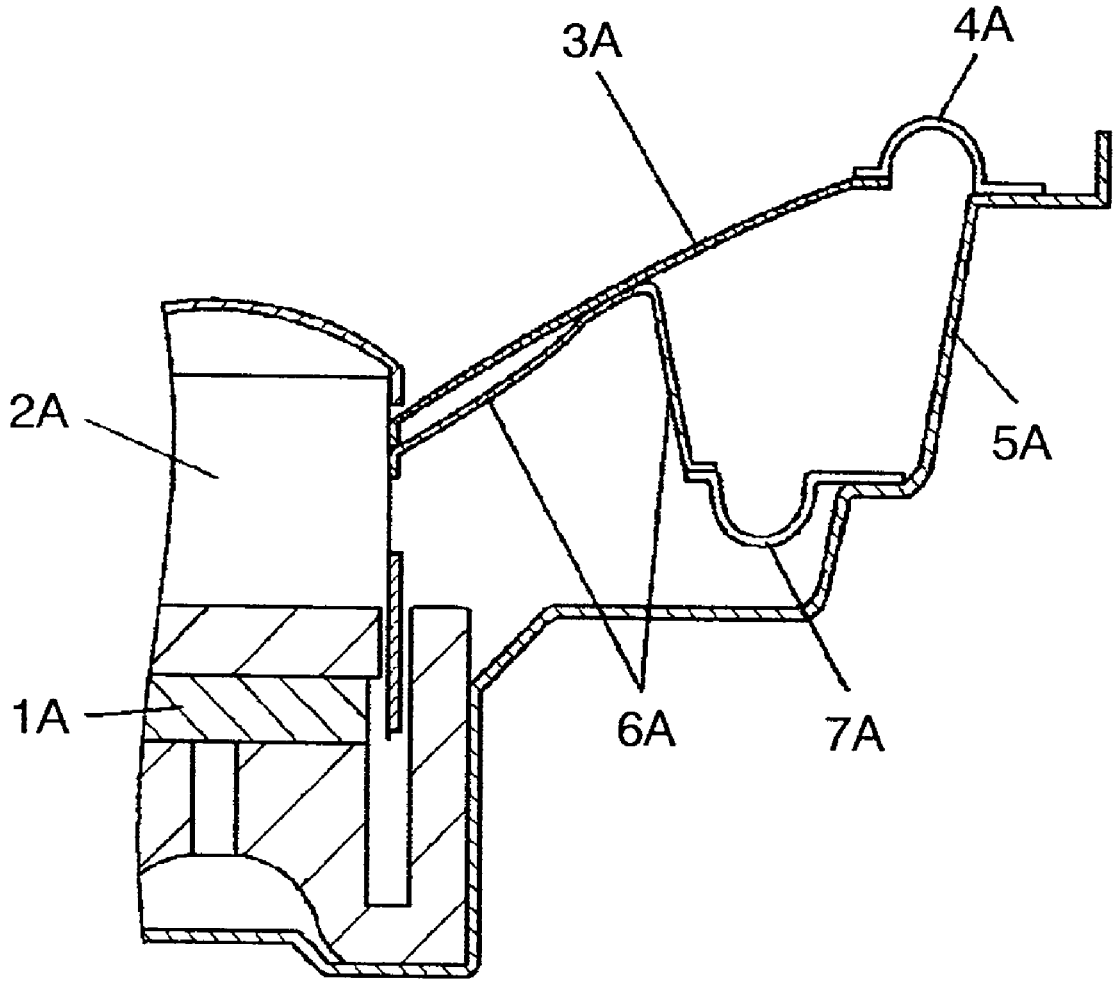
FIG. 8 PRIOR ART
FIG. 8 is a sectional view of a conventional loudspeaker.

In the present embodiment, third edges 11*b*, 11*c*, and 11*e* are formed as separate members from second edges 11*a* and 11*d*. However, it is alternatively possible to use a coupled edge that has been cast in one piece and consists of a second edge having a downward protrusion and a third edge having an upward protrusion, these protrusions being protruding from the surface of damper 10. Such examples are shown in FIGS. 6 and 7. FIGS. 6 and 7 show the cross sectional views of coupled edges 11*f* and 11*m*, respectively, which have been cast in one piece each.

Coupled edge 11*f* shown in FIG. 6 consists of one upward protrusion 11*g* and two downward protrusions 11*h* when seen in a cross section and is fixed to damper 10 at termination area 12. In the example of FIG. 6, protrusion 11*g* and protrusion 11*h* are opposite to each other with a space therebetween.

Coupled edge 11*m* shown in FIG. 7 consists of one upward protrusion 11*n* and two downward protrusions 11*p* when seen in a cross section. Protrusion 11*n* protrudes above damper surface AA. Coupled edge 11*m*, which is fixed to damper 10 at termination area 12, can be easily formed by hot pressing a single sheet.

Coupled edge 11*f* shown in FIG. 6 is an example of a coupled edge that has been cast in one piece and consists of second edge 11*d* and third edge 11*b* shown in FIG. 4. The coupled edges shown in FIGS. 2, 3 and 5 can be also formed as coupled edges that have been cast in one piece each.

In coupled edge 11*m* shown in FIG. 7, the number of upward protrusions 11*n* may be larger than the number of downward protrusions 11*p* depending on the shape and the number of the protruding portions.

In the examples of FIGS. 6 and 7, upward protrusions 11*g* and 11*n* of coupled edges 11*f* and 11*m*, respectively, preferably have Young's moduli that are larger than that of first edge 4 and lower than those of downward protrusions 11*h* and 11*p* of coupled edge 11*f* and 11*m*, respectively.

The loudspeaker of the present embodiment has little distortion because of the symmetrical vertical excursion of diaphragm 3 and also because of the improved excursion linearity or power linearity of the loudspeaker. The loudspeaker also has high driving efficiency even as a mid/high-range loudspeaker because edge 4 has a reduced weight.

INDUSTRIAL APPLICABILITY

The loudspeaker of the present invention, which has little loudspeaker distortion and high driving efficiency, is useful especially as full-range, mid-range, and high-range loudspeakers.

The invention claimed is:

1. A loudspeaker comprising:

a frame;

a magnetic circuit supported by the frame;

a voice coil disposed in a magnetic gap of the magnetic circuit so as to be able to vibrate freely in the gap;

a diaphragm connected to the frame at an outer rim thereof via a first edge and connected to the voice coil at an inner rim thereof;

a damper connected to the voice coil at an inner rim thereof, the damper being closer to the magnetic circuit than the diaphragm is close to the magnetic circuit;

a second edge having first and second ends for respectively connecting an outer rim of the damper to the frame; and a third edge having first and second ends each coupled to the respective first and second ends of the second edge, wherein the second edge has a protrusion protruding one of toward the diaphragm and toward the frame opposite to each other; and the third edge has a protrusion protruding at least in an opposite direction in which the protrusion of the second edge protrudes.

2. The loudspeaker of claim 1 wherein the damper, the second edge, and the third edge form a combination and the combination has a larger Young's modulus than the first edge.

3. The loudspeaker of claim 2, wherein the third edge has a lower Young's modulus than the second edge.

4. The loudspeaker of claim 2, wherein the third edge is made of a foamed resin, and the second edge is made of a rubber material.

5. The loudspeaker of claim 4, wherein the first edge and the third edge are made of an urethane resin, and the first edge has a lower Young's modulus than the third edge.

6. The loudspeaker of claim 1, wherein the third edge has a Young's modulus larger than the Young's modulus of the first edge and lower than the Young's modulus of the second edge.

7. A loudspeaker comprising:

a frame;

a magnetic circuit supported by the frame;

a voice coil disposed in a magnetic gap of the magnetic circuit so as to be able to vibrate freely in the gap;

a diaphragm connected to the frame at an outer rim thereof via a first edge and connected to the voice coil at an inner rim thereof;

a damper connected to the voice coil at an inner rim thereof, the damper being between the diaphragm and the frame; and a coupled edge connecting an outer rim of the damper to the frame, the coupled edge having an upward protrusion protruding above a surface of the damper and a downward protrusion protruding below the surface of the damper, wherein the upward protrusion of the coupled edge has a Young's modulus larger than the Young's modulus of the first edge and lower than the Young's modulus of the downward protrusion of the coupled edge.

8. The loudspeaker of claim 7, wherein the damper and the coupled edge form a combination, and the combination has a larger Young's modulus than the first edge.

9. The loudspeaker of claim 7, wherein the first edge has an upward protrusion.

10. The loudspeaker of claim 7, wherein the upward protrusion is opposed to the downward protrusion.

11. The loudspeaker of claim 7, wherein the upward protrusion is adjacent to the downward protrusion.

* * * * *